US006619195B2

(12) United States Patent
Corcoran et al.

(10) Patent No.: US 6,619,195 B2
(45) Date of Patent: Sep. 16, 2003

(54) DIE PRESS WITH INTEGRAL COVER AND GUIDES AND IMPROVED DIE FEED SYSTEM

(75) Inventors: Kevin L. Corcoran, Mission Viejo, CA (US); David L. Hughes, Jr., Rancho Santa Margarita, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 0 days.

(21) Appl. No.: 10/190,228

(22) Filed: Jul. 3, 2002

(65) Prior Publication Data

US 2003/0019370 A1 Jan. 30, 2003

Related U.S. Application Data

(60) Provisional application No. 60/303,031, filed on Jul. 3, 2001.

(51) Int. Cl.[7] ..... B30B 9/32

(52) U.S. Cl. ..... 100/291; 100/224; 100/229 R; 100/292

(58) Field of Search ..... 100/224, 229 R, 100/232, 291, 292

(56) References Cited

U.S. PATENT DOCUMENTS

| | | | | |
|---|---|---|---|---|
| 1,453,405 | A | 5/1923 | Platt | |
| 1,658,823 | A | 2/1928 | Willard | |
| 2,112,011 | A | 3/1938 | Byerlein | 78/41 |
| 3,094,091 | A | 6/1963 | Peccerill | 113/44 |
| 3,935,811 | A | 2/1976 | Lenz et al. | 100/53 |
| D257,777 | S | 1/1981 | Eichenberg et al. | D18/15 |
| D296,565 | S | 7/1988 | Eichenberg et al. | D18/14 |
| 5,255,587 | A | 10/1993 | Eichenberg et al. | 83/628 |
| D341,842 | S | 11/1993 | Eichenberg et al. | D15/123 |
| D359,967 | S | 7/1995 | Eichenberg et al. | D15/123 |
| 5,628,226 | A | 5/1997 | Weissman | 72/451 |
| 5,775,213 | A | 7/1998 | Hyde | 100/215 |
| D468,187 | S | 1/2003 | Corcoran et al. | D8/312 |
| D472,564 | S | 4/2003 | Corcoran et al. | D15/123 |

*Primary Examiner*—William Hong

(74) *Attorney, Agent, or Firm*—Thomas E. Coverstone; Townsend and Townsend and Crew LLP

(57) ABSTRACT

Disclosed is a die press, comprising a base, opposing first and second supports extending from the base, at least one cam member that is supported by the opposing supports, means for rotating the cam member, at least one bearing located on the cam member, a platen positioned generally between the at least one bearing and the base, and a cover being unitary with the platen, the cover being slidably engaged with the opposing supports to guide the platen during operation of the die press.

31 Claims, 7 Drawing Sheets

DIE PRESS WITH INTEGRAL COVER AND GUIDES AND IMPROVED DIE FEED SYSTEM

RELATED APPLICATIONS

This application relates to Provisional Application Serial No. 60/303,031, filed on Jul. 3, 2001 and entitled Die Press with Integral Cover and Guides and Improved Die Feed System.

FIELD OF THE INVENTION

The present invention relates to sheet cutting presses and, more particularly, a sheet cutting press with improvements directed to a guide for the platen and an improved die feed system.

BACKGROUND OF THE INVENTION

Dies and sheet cutting presses are used to cut various patterns out of sheet materials. The presses are designed to apply uniform pressure to a platen and die to cut through a sheet or a plurality of sheets simultaneously. The forces that are generated during the cutting action oftentimes force the platen to become nonparallel in relation to the die, which may result in an uneven or incomplete cut through the sheet material. Therefore, in the past, improvements to die presses have been directed toward maintaining the platen parallel in relation to the die throughout the cutting stroke.

SUMMARY OF THE INVENTION

Disclosed is a die press, comprising a base, opposing first and second supports extending from the base, at least one cam member that is supported by the opposing supports, means for rotating the cam member, at least one bearing located on the cam member, a platen positioned generally between the at least one bearing and the base, and a cover being unitary with the platen, the cover being slidably engaged with the opposing supports to guide the platen during operation of the die press.

In another aspect of the invention, disclosed is a die press, comprising a base, an upper platen opposite of the base, means for moving the upper platen toward the base by rotating at least one cam member, and means for guiding the upper platen.

In another aspect of the invention, disclosed is a die press, comprising a base, opposing first and second supports extending from the base, a cam member that is supported by the opposing supports, means for rotating the cam member, a plurality of bearings located on the cam member, an upper platen positioned generally between the bearings and the base, and a cover being attached to the platen to define a unitary structure, the cover being slidably engaged with the opposing supports to guide the upper platen during operation of the die press and to resist torsional forces.

In yet another aspect of the invention, disclosed is a die press, comprising a base, at least two opposing supports extending from the base, at least one cam member that is supported by the opposing supports, a handle extending from the cam member, an upper platen positioned between the bearings and the base, the base further including at least two rails extending from the base, the rails being adapted to support a die.

Further, disclosed is a cover used with the die press which has stiffening ribs to resist torsional forces applied to the cover during operation of the press. Also disclosed is a feed system to feed a die or shuttle into the platen working area by utilizing rails that extend from the base. Each rail further includes a cutout, and the cutouts oppose each other to define a track so that a die or shuttle may be moved along the track into and out of a working area between the platen and the base.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
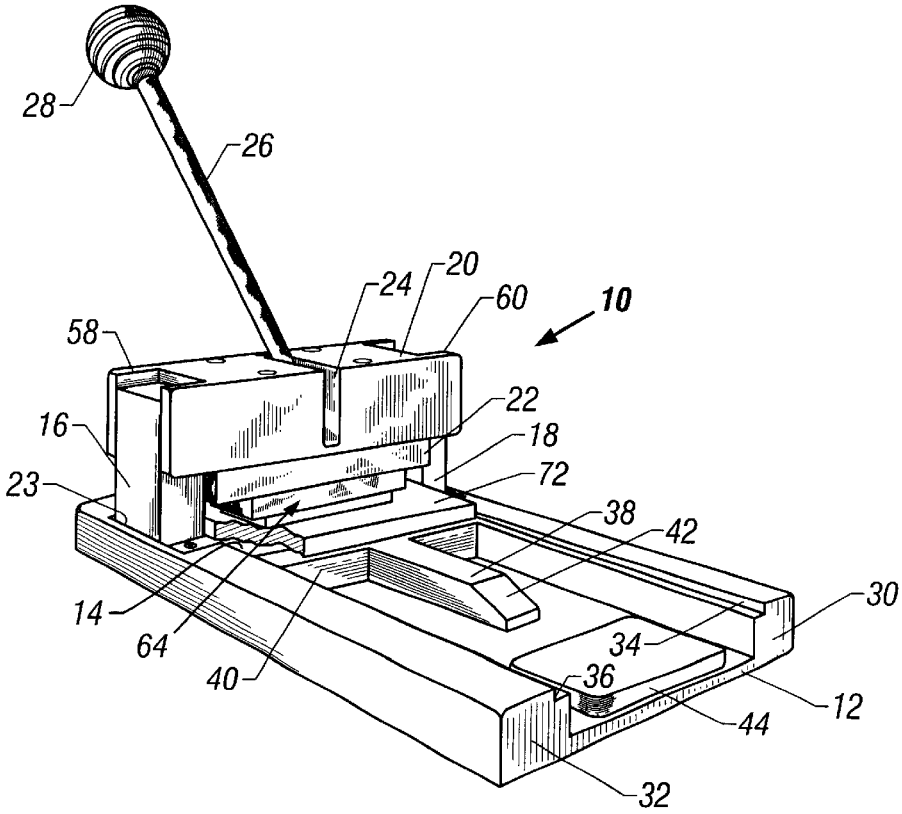
FIG. 1 is a front perspective view of the die press according to the present invention in an open position.

Incorporated herein by reference, in its entirety, is U.S. Pat. No. 5,255,587. A die press 10 according to the present invention is shown in FIG. 1. The die press 10 includes a base 12 with a lower platen 14 attached to the base 12. The die press further includes opposing supports. A first support 16 and an opposing second support 18 both extend upward from the lower platen 14. In the alternative, the supports may extend from the base 12 or the rails on the base. As will be further described below, the supports 16 and 18 support a cam roller and two bearings. The cam roller and bearings are covered by integral cover 20. Attached to integral cover 20 by a plurality of fasteners is an upper platen 22. The integral cover 20 includes a cutout 24 for handle 26. The handle 26 extends from the cam roller, and attached to the distal end of the handle 26 is a grip 28.

Figure 2:
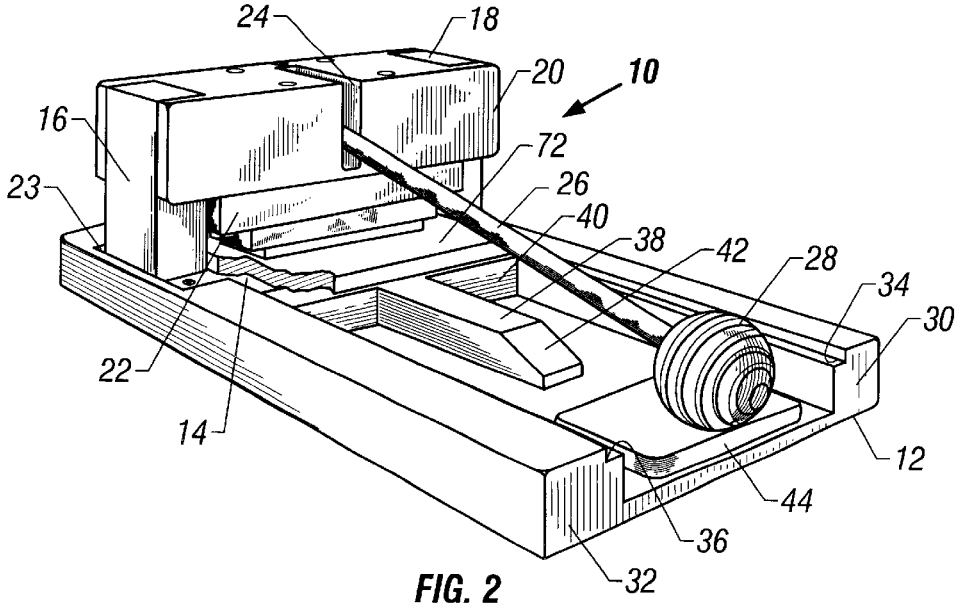
FIG. 2 is a front perspective view of the die press according to the present invention in a closed position.

As shown in FIGS. 1 and 2, extending from and generally along the length of the base 12 at a first edge is a first rail 30. An opposing second rail 32 extends from and generally along the length of the base 12 at a second edge. The rails are generally parallel to each other to define a "U" shape area with the base. The first rail 30 includes a cutout 34 that extends the length of the rail 30. Likewise, the opposing second rail 32 includes a second rail cutout 36, which extends along the length of the second rail 32. The rails and cutouts are generally symmetrical to each other to define a track for the die or shuttle. Positioned between the first rail 30 and the second rail 32 is a center rail 38, which extends upwards from the base 12 and from a step 40, which is adjacent to the lower platen 14. The center rail 38 includes a chamfered corner 42 to accommodate the operator's hands and fingers during operation of the die press. Also extending from base 12 is a pad 44, which is adjacent to the area where the grip 28 meets the base 12 when the die press is operated and in the closed cutting position. The pad 44 is made of a soft rubber material and provides a cushion for the operator's hand and knuckles during operation of the die press.

Figure 9:
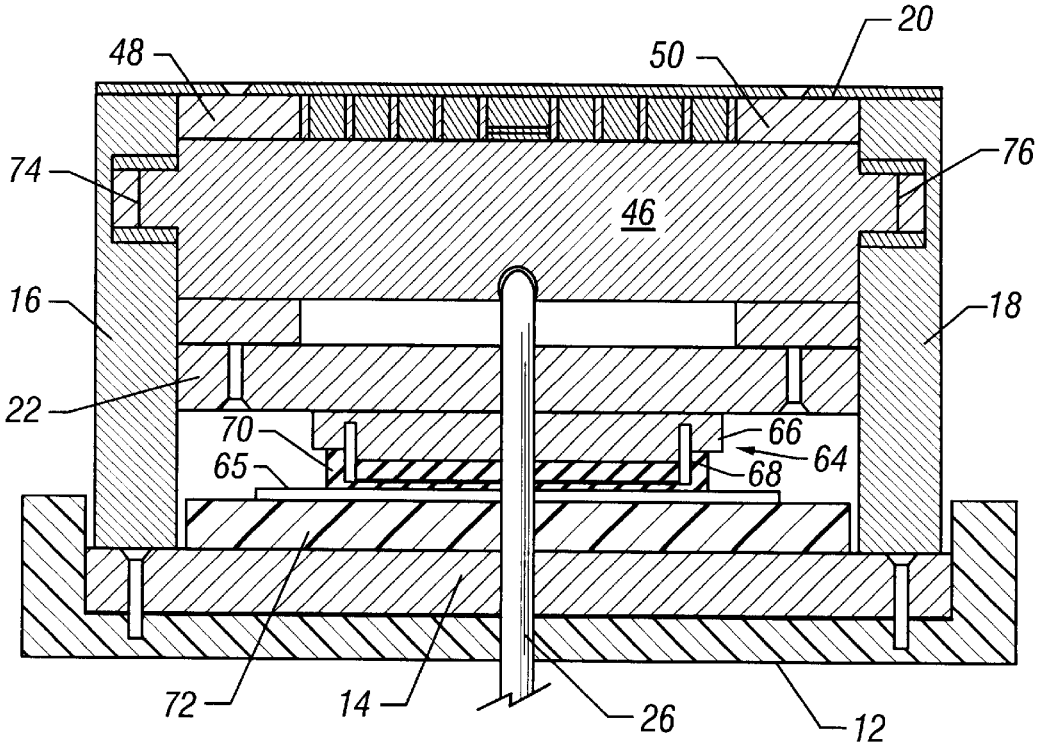
FIG. 9 is a front cross-sectional view taken from line 9—9 of FIG. 8.
Figure 10:
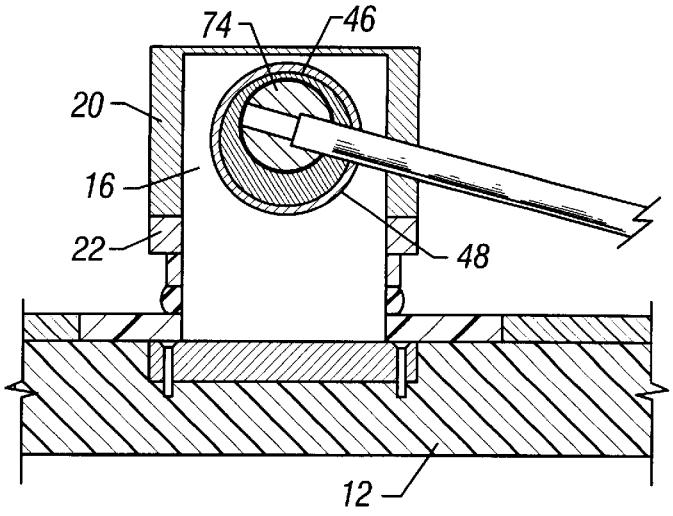
FIG. 10 is a side cross-sectional view taken from line 10—10 of FIG. 4.

As shown in FIGS. 9 and 10, the first support 16 is opposite of the second support 18. The supports 16 and 18 support a cam member 46. A first bearing 48 is located at a first end of the cam member 46, and a second bearing 50 is located at the opposite second end of the cam member 46. The bearings 48 and 50 and the cam member 46 are located off concentric center in relation to the shaft ends 74 and 76 of the cam member. In one embodiment, the shaft ends 74 and 76 are housed in bearings or sleeves located in the first and second supports 16 and 18. In the alternative, the shaft ends may be housed directly in the supports.

The upper platen 22 is positioned between the bearings and the lower platen 14. The integral cover 20 is fastened to the upper platen 22, so as to encompass the first and second bearings 48 and 50. As will be further explained below, the integral cover 20 cooperates with the cam member 46 so that when the cam member 46 is rotated by the handle 26 being lowered, the integral cover 20 is lowered and likewise the upper platen 22 is lowered against a die 64 positioned between the upper and lower platens. When additional pressure is applied to the handle 26, the cam member 46 is rotated even further and uniform pressure is applied to the upper platen 22 via the bearings 48 and 50. In an alternative embodiment, additional bearings are located on the cam member so that additional or more uniform pressure may be applied to the upper platform.

Figure 11:
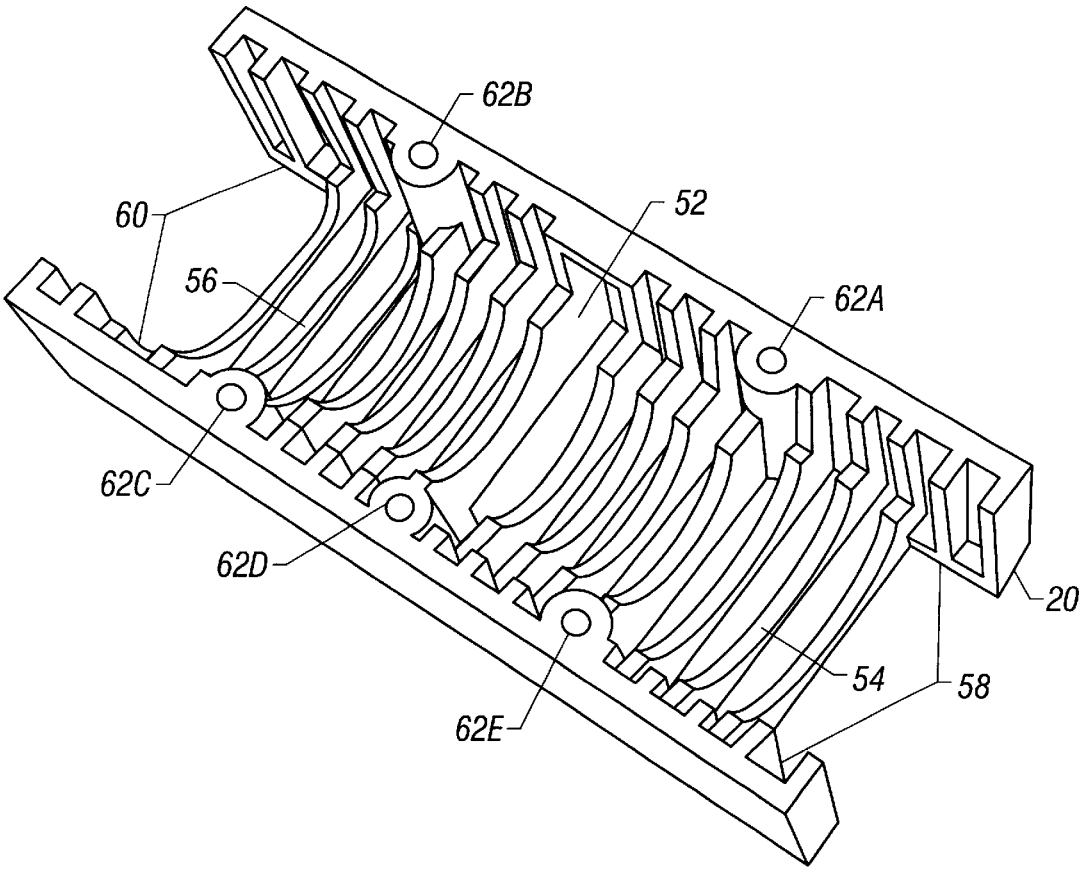
FIG. 11 is a bottom perspective view of the cover according to the present invention.
Figure 12:
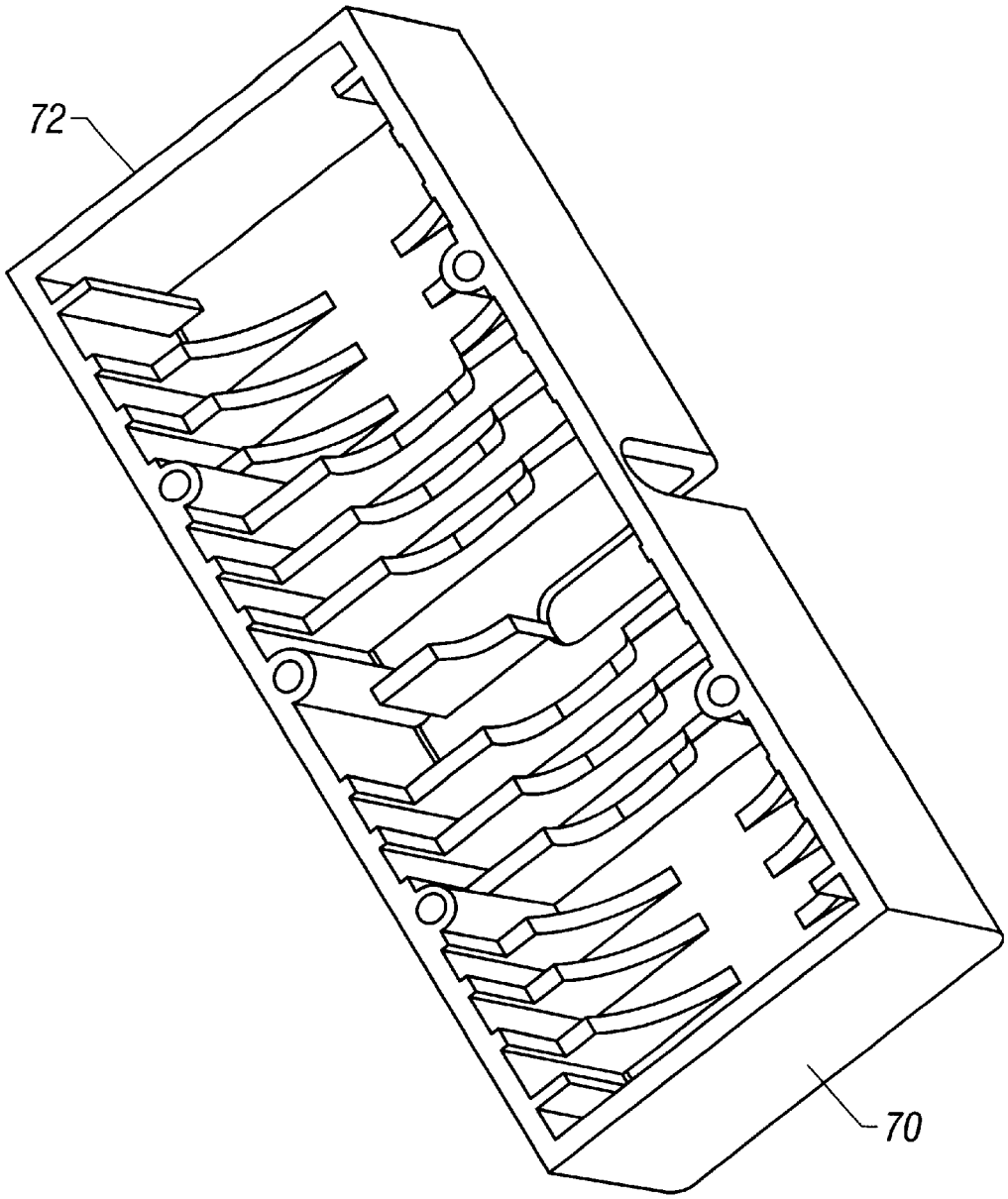
FIG. 12 is an alternative embodiment showing a bottom perspective view of the cover according to the present invention.

As shown in FIG. 11, the cover 20 includes a plurality of internal stiffening ribs 52. The ribs are configured so as to include a first rib cutout 54 at a first end and an opposite second rib cutout 56 at a second end. The rib cutouts 54 and 56 are provided to accommodate the bearings located on the cam member. If additional bearings are utilized, then additional cutouts would be provided in the cover. The ribs 52 prevent lateral movement of the bearings along the cam member. The ribs also provide a stiffening feature to the cover. For example, when forces are applied to the upper platen, resistive and torsional forces are transferred to the cover. The ribs stiffen the cover, which also limits distortion of the cover and further allows uniform pressure to be applied to the upper platen since the cover and the upper platen are fastened together to work as a unitary component of the press. In the embodiment shown, the ribs are generally evenly spaced apart from a first end of the cover to a second end of the cover. In the alternative, any other structure adding strength to the cover would achieve the same objective. An alternative embodiment is shown in FIG. 12, wherein end caps 70 and 72 are added to the cover. The end caps add additional rigidity to the cover and generally encompass the respective first and second supports around their perimeters while still being slidably engaged with the first and second supports. The cover 20 further includes a first guide recess with bearing surfaces 58 and an opposite second guide recess with bearing surfaces 60. The guide recesses allow the cover 20 to be slidably engaged with the first and second supports 16 and 18 primarily at the front and rear surfaces of the supports 16 and 18. This arrangement resists the torsional forces applied to the cover and upper platen during the operation of the press. The engagement between the cover 20 and the first and second supports 16 and 18 as well as the ribs in the cover maintain the upper platen 22 parallel to the lower platen 14 throughout the cutting stroke. The cover 20 further includes fastener apertures 62*a–e* for fastening the cover 20 to the upper platen 22 so that the cover and the upper platen move as a unitary component.

FIG. 9 illustrates how the die press 10 cooperates with a die 64 located between the upper and lower platens. The die includes a die base 66, which may be made of plastic, plywood, metal, or other suitable material. A steel rule blade 68 extends from the die base 66 and has a sharp edge around its distal edge. A rubber neoprene material 70 is attached to the die base 66 so as to protect the sharp edge of the steel rule blade 68.

During operation, a shuttle is used to protect the user by allowing a means to keep the user's fingers out of the working area of the press. The shuttle is used to slide the die 64, the sheet material 65 to be cut into the work area between the upper and lower platens. The shuttle comprises a cutting pad 72 made of a flexible but resilient plastic material. In the alternative, the shuttle may be the cutting pad, the die, and the sheet material. The cutting pad 72 is adapted to slide along the first and second rails 30 and 32 by fitting into the first and second rail cutouts 34 and 36. The operator positions the cutting pad away from the platens and adjacent to pad 44, then places the sheet material 65 to be cut on the cutting pad 72, and then places the selected cutting die with the rubber material 70 in contact with the sheet material 65 on the cutting pad 72. The operator then slides the cutting pad, sheet material, and die into the work area between the platens by sliding the cutting pad 72 along the first and second rail cutouts 34 and 36. The operator then lowers the handle 26 by applying force to the grip 28 and, as will be further explained below, at the end of the cutting stroke, force is applied to the upper platen 22 and to the die through the handle 26 and the bearings 48 and 50. The rubber 70 yields to expose the steel rule blade 68 and likewise, as force is further applied, the steel rule blade 68 cuts through the sheet material 65 and either cuts against or slightly into the cutting pad 72. The handle 26 is then raised, and the operator slides the cutting pad, sheet material, and die out of the work area to gain access to the resulting shape that has been cut from the sheet material. The operator may utilize one sheet or a plurality of sheets of paper or other materials, such as laminates, for the material to be cut.

The die 64 could further be dimensioned so as to fit within the first and second rail cutouts 34 and 36. In this embodiment, the die would be slid along the rails into the work area. Also, the die 64 could further be dimensioned so as to rest upon the center rail 38 and one of the rail cutouts 34 or 36. Or, another alternative may be that the cutting pad 72 and the die 64 may be rotated upside down 180° and placed into the work area so that the upper platen 22 applies force directly to the cutting pad 72 instead of directly to the die 64. In this alternative, a full size die would rest in the first and second rail cutouts 34 and 36. If a smaller die is used in this fashion, the die would rest on the center rail and one of the rail cutouts.

As described above and as shown in FIGS. 9 and 10, when the handle 26 is in the down position, a force is applied to the upper platen 22 and to the die 64 to cut a shape out of the sheet material 65 that is positioned between the die 64 and the cutting pad 72. When the handle 26 is in the down position, forces are transferred from the cam member 46 via bearings 48 and 50 to the upper platen 22. The bearings 48 and 50 are arranged to allow for an even distribution of the forces across the upper platen 22 to the die 64. Further, as stated above, the first and second guide recesses 58 and 60 of the integral cover 20 the stiffening ribs in the cover, and the first and second supports 16 and 18 provide means for maintaining the upper platen 22 parallel to the lower platen 14 throughout the cutting stroke. The parallel orientation of the platens allows for an even distribution of forces from the upper platen to the die, and ultimately from the die to the material being cut or embossed.

As shown in FIG. 9, the cam member 46 includes a first shaft end 74 shown extending into the first support 16. An opposite second shaft end 76 likewise extends into the second support 18. The shaft ends 74 and 76 are housed in bearings or sleeves located in the first and second supports 16 and 18. As is further shown in FIG. 10, the diameter of cam member 46 is offset from the diameter of the first and second shaft ends 74 and 76. Therefore, when the handle 26 is in the down position, the cam member 46 applies force to the upper platen 22 via the corresponding bearings 48 and 50. The force is then transferred to the die 64, and the cutting or embossing action is completed through the sheet or plurality of sheets of material 65.

As shown in FIGS. 1 and 2, the first and second supports 16 and 18 as well as the upper and lower platens are seated in a recess 23 located in the base 12. The first and second supports are fastened to the base 12 with fasteners. In the alternative, instead of a recess in the base, the supports and the lower platen could extend through the base, dividing the base into two components. The two components would include a front portion and a rear portion, both of which would be fastened in front of and behind the first and second supports, respectively. This configuration allows the base to be made of plastic, while the other components of the press that experience compressive forces are made of a structurally stronger material, such as a metal alloy or a composite material.

Figure 3:
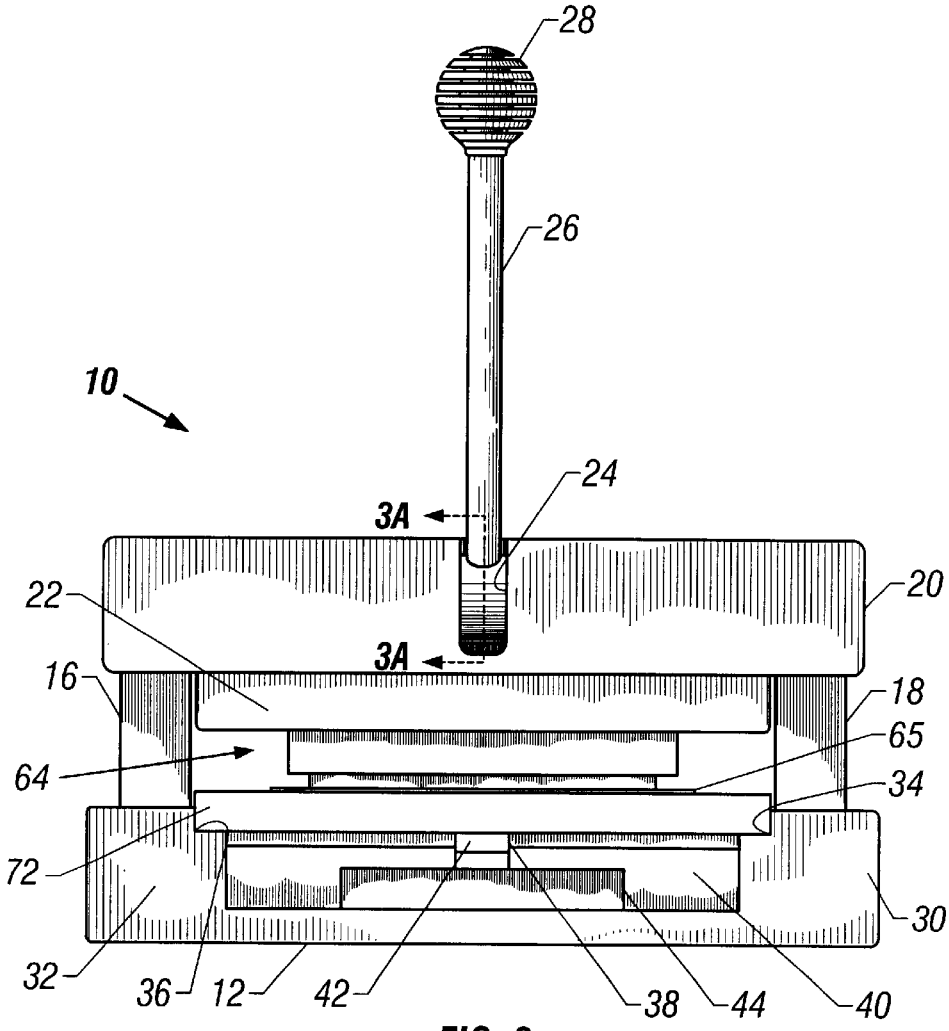
FIG. 3 is a front elevational view of the die press according to the present invention in an open position.
Figure 3A:
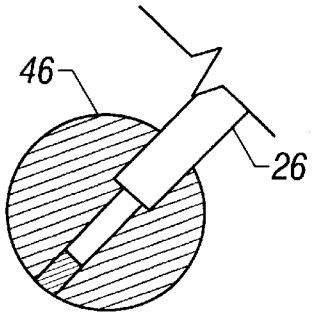
FIG. 3A is a close-up cross-sectional view of a handle and a cam member connection as taken from line 3*a*—3*a* of FIG. 3.
Figure 4:
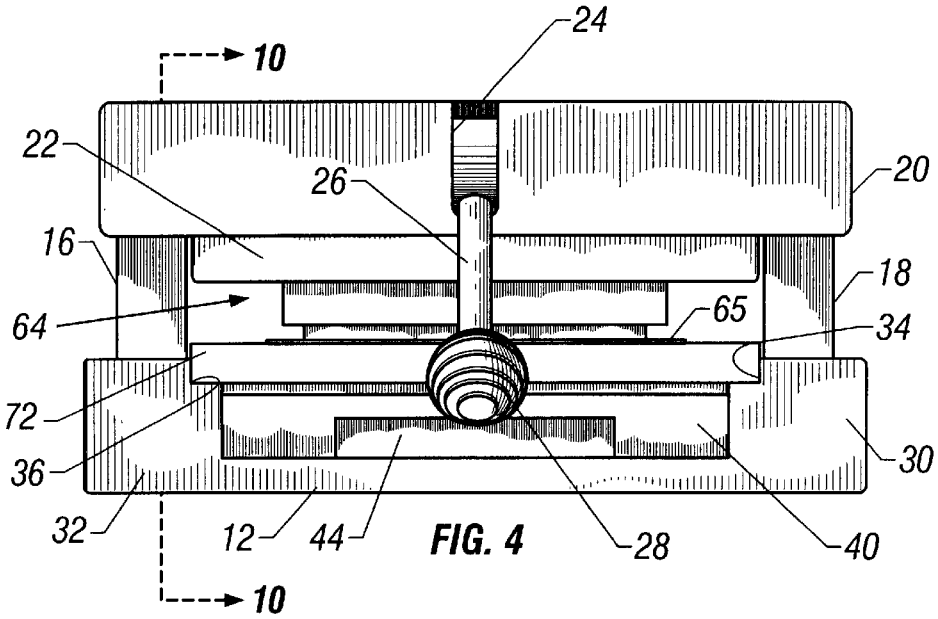
FIG. 4 is a front elevational view of the die press according to the present invention in a closed position.
Figure 5:
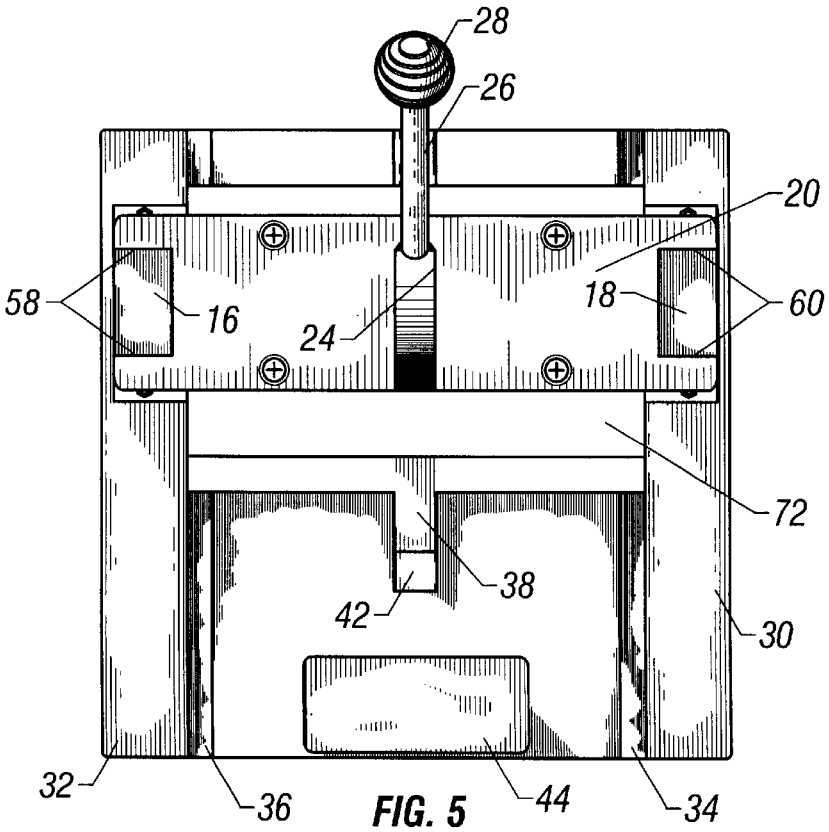
FIG. 5 is a top plan view of the die press according to the present invention in an open position.
Figure 6:
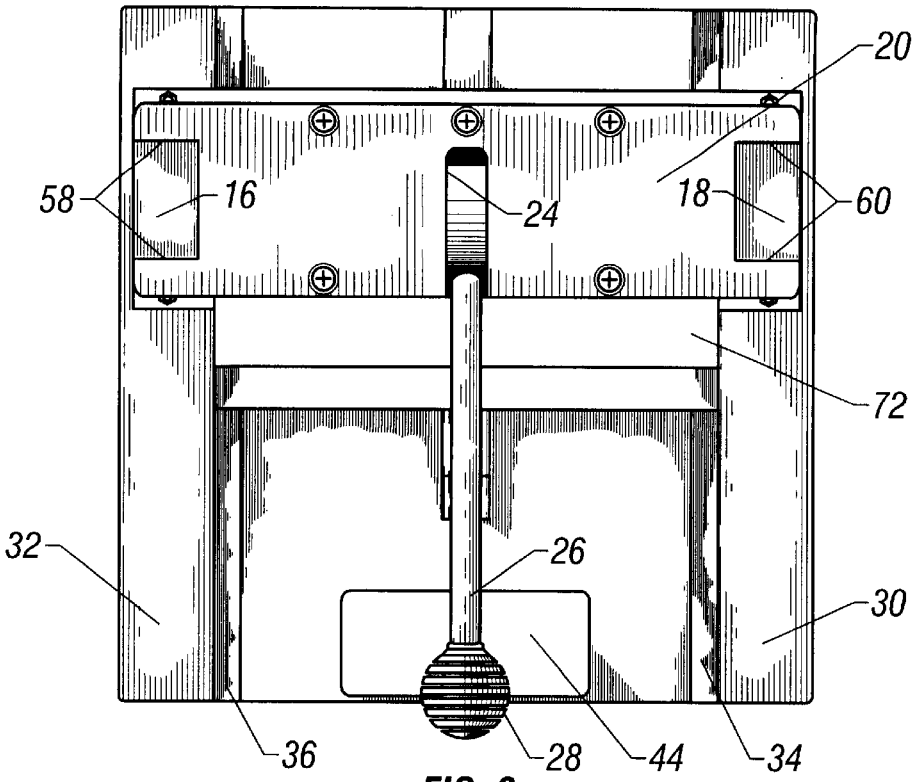
FIG. 6 is a top plan view of the die press according to the present invention in a closed position.
Figure 7:
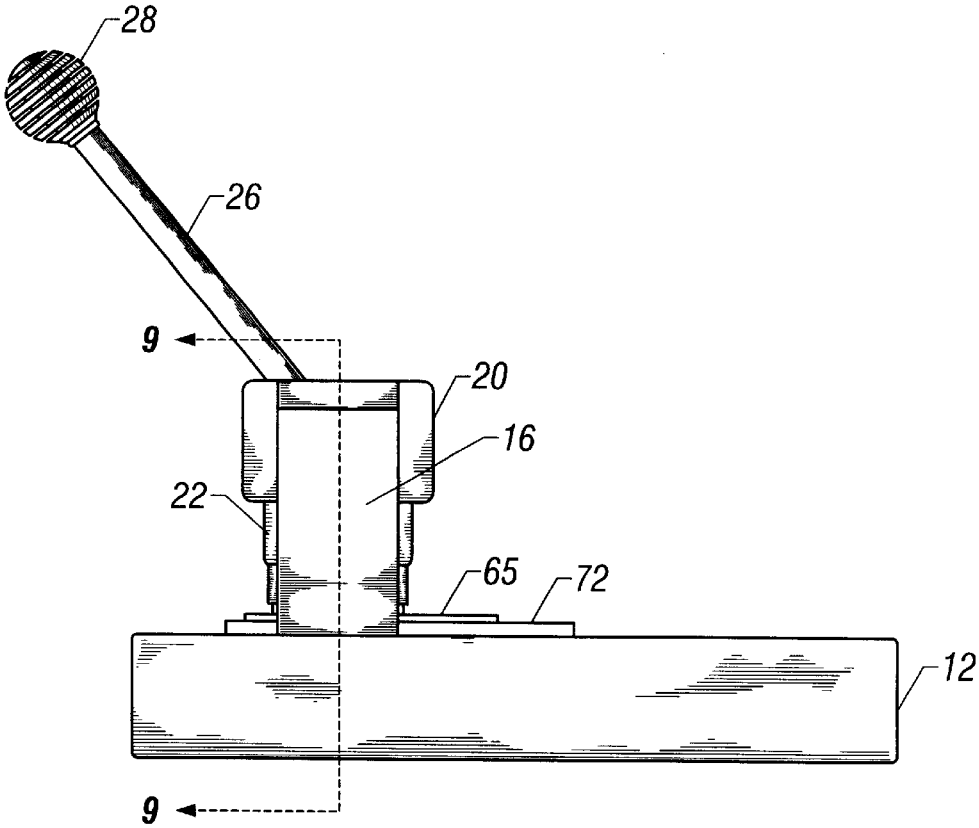
FIG. 7 is the side elevational view of the die press according to the present invention in an open position.
Figure 8:
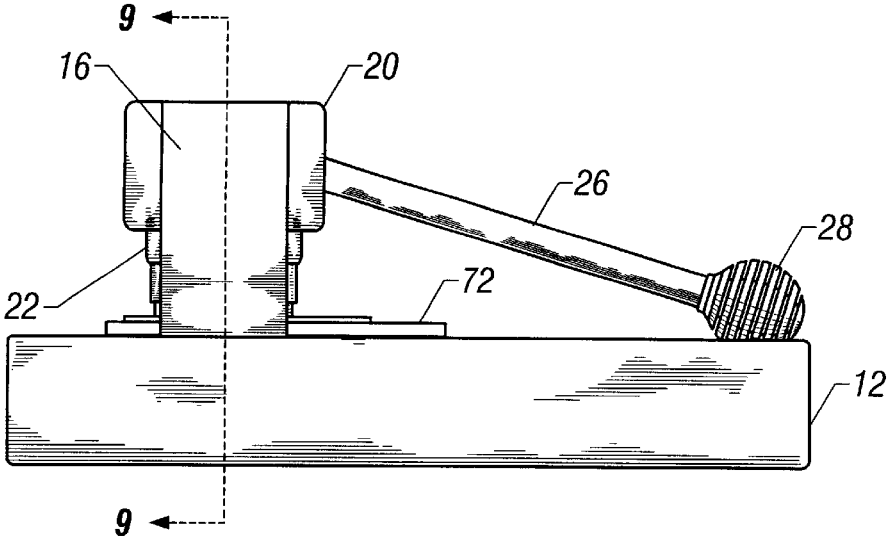
FIG. 8 is side elevational view of the die press according to the present invention in a closed position.

As shown in FIG. 3A, the handle 26 includes a recessed portion at the distal end that mates with a counterbore in the cam member 46. The recess aids with assembling the handle into the cam member since the depth of insertion is controlled by the counterbore. The handle may be press fit into the cam member, or the handle may be glued or otherwise secured to the cam member. Examples of the connecting means of the handle to the cam member include welding, fastening, pinning, or the handle and the cam member may be cast to provide one unitary structure. If the handle is glued to the cam member, the recessed portion of the handle may be knurled to provide a better contact surface for the adhesive.

Although this invention has been shown and described with respect to detailed embodiments, those skilled in the art will understand that various changes in form and detail may be made without departing from the scope of the claimed invention.

We claim:

1. A die press, comprising:

a base;

opposing first and second supports extending from the base;

at least one cam member that is supported by the opposing supports;

means for rotating the cam member;

at least one bearing located on the cam member;

a platen positioned generally between the at least one bearing and the base;

a center rail extending upward from the base and having a chamfered corner;

and a cover being unitary with the platen, the cover being slidably engaged with the opposing supports to guide the platen during operation of the die press.

2. The die press according to claim 1, wherein the cover has a first end that is slidably engaged with the first support, and a second end that is slidably engaged with the second support.

3. The die press according to claim 2, wherein the cover has a first end cap and a second end cap so that the first and second supports are generally encompassed.

4. The die press according to claim 1, wherein the cover includes at least one stiffening component.

5. The die press according to claim 4, wherein the stiffening component is at least one rib.

6. The die press according to claim 5, wherein the at least one rib is located internally of the cover.

7. The die press according to claim 4, wherein the cover includes a plurality of ribs.

8. The die press according to claim 7, wherein at least one rib includes at least one cutout to accomodate the at the least one bearing.

9. The die press according to claim 7, wherein the ribs include cutouts to accomodate a plurality of bearings located on the cam member.

10. The die press according to claim 1, wherein the cover is attached to the platen.

11. The die press according to claim 1, wherein the means for rotating the cam member includes a lever member extending from the cam member.

12. The die press according to claim 11, wherein the lever member is a handle extending from the cam member.

13. The die press according to claim 1, wherein the rotation of the cam member provides for movement of the platen.

14. The die press according to claim 13, wherein forces are transferred from the cam member to the platen when the cam member is rotated.

15. The die press according to claim 1, wherein the platen is an upper platen.

16. The die press according to claim 1, wherein the die press further includes means for feeding a die into a working area between the platen and the base.

17. The die press according to claim 1, wherein the die press further includes means for feeding a shuttle into a working area between the platen and the base.

18. The die press according to claim 1, wherein the base further includes a pair of opposing rails defining a track.

19. The die press according to claim 18, wherein each rail further includes a cutout.

20. The die press according to claim 19, wherein the cutouts oppose each other to define a track so that a die or shuttle may be moved along the track into and out of a working area between the platen and the base.

21. The die press according to claim 20, wherein the opposing supports have front and rear surfaces, and the cover is slidably engaged with the opposing supports at the front and rear surfaces of the opposing supports to guide the upper platen during operation of the die press and to resist torsional forces.

22. The die press according to claim 18, wherein the base further includes the center rail extending from the base, the center rail being located between the two rails.

23. The die press according to claim 1, wherein the opposing supports have front and rear surfaces, and the cover is slidably engaged with the opposing supports at the front and rear surfaces of the opposing supports to guide the upper platen during operation of the die press and to resist torsional forces.

24. A die press, comprising:

a base;

opposing first and second supports extending from the base;

a cam member that is supported by the opposing supports;

means for rotating the cam member;

a plurality of bearings located on the cam member;

an upper platen positioned generally between the bearings and the base; and a center rail extending upward from the base and having a chamfered corner;

a cover being attached to the platen to define a unitary structure, the cover being slidably engaged with the opposing supports to guide the upper platen during operation of the die press and to resist torsional forces.

25. The die press according to claim 24, wherein the cover includes a plurality of stiffening ribs.

26. The die press according to claim 24, wherein the die press further includes means for feeding a die into a working area between the platen and the base.

27. The die press according to claim 24, wherein the die press further includes means for feeding a shuttle into a working area between the platen and the base.

28. The die press according to claim 24, wherein the base further includes a pair of opposing rails defining a track.

29. The die press according to claim 28, wherein each rail further includes a cutout.

30. The die press according to claim 29, wherein the cutouts oppose each other to define a track so that a die or shuttle may be moved along the track into and out of a working area between the platen and the base.

31. The die press according to claim 28, wherein the base further includes the center rail extending from the base, the center rail being located between the two rails.

* * * * *